US008655211B2

(12) United States Patent
Fujimoto et al.

(10) Patent No.: US 8,655,211 B2
(45) Date of Patent: Feb. 18, 2014

(54) FIXING DEVICE AND IMAGE FORMING APPARATUS INCORPORATING SAME

(75) Inventors: Ippei Fujimoto, Kanagawa (JP); Yuji Arai, Kanagawa (JP); Hiromasa Takagi, Tokyo (JP); Yoshiki Yamaguchi, Kanagawa (JP); Naoki Iwaya, Tokyo (JP); Arinobu Yoshiura, Kanagawa (JP); Toshihiko Shimokawa, Kanagawa (JP); Tetsuo Tokuda, Kanagawa (JP); Yutaka Ikebuchi, Kanagawa (JP); Kenji Ishii, Kanagawa (JP); Takahiro Imada, Kanagawa (JP); Hiroshi Yoshinaga, Chiba (JP); Takuya Seshita, Kanagawa (JP); Hajime Gotoh, Kanagawa (JP); Masaaki Yoshikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 13/286,796

(22) Filed: Nov. 1, 2011

(65) Prior Publication Data

US 2012/0114345 A1 May 10, 2012

(30) Foreign Application Priority Data

Nov. 9, 2010 (JP) ..... 2010-251000

(51) Int. Cl.
*G03G 15/20* (2006.01)

(52) U.S. Cl.
USPC ..... 399/67; 399/44; 399/45; 399/329

(58) Field of Classification Search
USPC ..... 399/67, 68, 44, 45, 328, 329; 219/216
See application file for complete search history.

(56) References Cited

U.S. PATENT DOCUMENTS 7,957,663 B2 6/2011 Kishi et al. ..... 399/69
2004/0081491 A1* 4/2004 Uchida et al. ..... 399/328

(Continued)

FOREIGN PATENT DOCUMENTS

JP 2003-215953 7/2003
JP 2007-333991 A * 12/2007

(Continued)

OTHER PUBLICATIONS

Machine translation of JP 2003-215953 (published on Jul. 30, 2003) dated Jul. 15, 2013.*

(Continued)

*Primary Examiner* — Sophia S Chen
(74) *Attorney, Agent, or Firm* — Oblon, Spivak, McClelland, Maier & Neustadt, L.L.P.

(57) ABSTRACT

A fixing device includes a fixing belt; a pressing rotary body disposed outside a loop formed by the fixing belt; a nip formation pad disposed inside the loop formed by the fixing belt and pressed against the pressing rotary body via the fixing belt to form a fixing nip between the pressing rotary body and the fixing belt through which a recording medium bearing a toner image is conveyed. The nip formation pad includes a protrusion disposed downstream from the fixing nip in a conveyance direction of the recording medium and protruding toward the pressing rotary body without contacting the pressing rotary body. The fixing device further includes a pressing rotary body mover to contact and move the pressing rotary body bidirectionally in the conveyance direction of the recording medium to move the fixing nip toward and away from the protrusion.

16 Claims, 5 Drawing Sheets

(56) References Cited

U.S. PATENT DOCUMENTS

| | | | | |
|---|---|---|---|---|
| 2004/0151515 | A1* | 8/2004 | Nakayama | 399/67 |
| 2006/0239703 | A1* | 10/2006 | Kwon et al. | 399/45 |
| 2009/0154943 | A1* | 6/2009 | Ciaschi et al. | 399/45 |
| 2010/0092220 | A1 | 4/2010 | Hasegawa et al. | 399/328 |
| 2010/0092221 | A1 | 4/2010 | Shinshi et al. | 399/330 |
| 2010/0202809 | A1 | 8/2010 | Shinshi et al. | 399/329 |
| 2010/0290822 | A1 | 11/2010 | Hasegawa et al. | 399/329 |
| 2011/0026988 | A1 | 2/2011 | Yoshikawa et al. | 399/329 |
| 2011/0044734 | A1 | 2/2011 | Shimokawa et al. | 399/322 |
| 2011/0052237 | A1 | 3/2011 | Yoshikawa et al. | 399/69 |
| 2011/0052245 | A1 | 3/2011 | Shinshi et al. | 399/92 |
| 2011/0052277 | A1 | 3/2011 | Ueno et al. | 399/328 |
| 2011/0052282 | A1 | 3/2011 | Shinshi et al. | 399/329 |
| 2011/0058862 | A1 | 3/2011 | Yamaguchi et al. | 399/329 |
| 2011/0058863 | A1 | 3/2011 | Shinshi et al. | 399/329 |
| 2011/0058864 | A1 | 3/2011 | Fujimoto et al. | 399/329 |
| 2011/0058865 | A1 | 3/2011 | Tokuda et al. | 399/331 |
| 2011/0058866 | A1 | 3/2011 | Ishii et al. | 399/331 |
| 2011/0064437 | A1 | 3/2011 | Yamashina et al. | 399/67 |
| 2011/0064443 | A1 | 3/2011 | Iwaya et al. | 399/69 |
| 2011/0064450 | A1 | 3/2011 | Ishii et al. | 399/98 |
| 2011/0064451 | A1 | 3/2011 | Yamaguchi et al. | 399/99 |
| 2011/0064490 | A1 | 3/2011 | Imada et al. | 399/328 |
| 2011/0064502 | A1 | 3/2011 | Hase et al. | 399/406 |
| 2011/0076071 | A1 | 3/2011 | Yamaguchi et al. | 399/329 |
| 2011/0085832 | A1 | 4/2011 | Hasegawa et al. | 399/329 |
| 2011/0116848 | A1 | 5/2011 | Yamaguchi et al. | 399/329 |
| 2011/0129268 | A1 | 6/2011 | Ishii et al. | 399/333 |
| 2011/0150518 | A1 | 6/2011 | Hase et al. | 399/70 |
| 2011/0170917 | A1 | 7/2011 | Yoshikawa et al. | 399/329 |
| 2011/0176822 | A1 | 7/2011 | Ishii et al. | 399/45 |
| 2011/0182634 | A1 | 7/2011 | Ishigaya et al. | 399/328 |
| 2011/0182638 | A1 | 7/2011 | Ishii et al. | 399/333 |
| 2011/0194869 | A1 | 8/2011 | Yoshinaga et al. | 399/69 |
| 2011/0194870 | A1 | 8/2011 | Hase et al. | 399/69 |
| 2011/0200368 | A1 | 8/2011 | Yamaguchi et al. | 399/328 |
| 2011/0200370 | A1 | 8/2011 | Ikebuchi et al. | 399/329 |
| 2011/0206427 | A1 | 8/2011 | Iwaya et al. | 399/329 |
| 2011/0211876 | A1 | 9/2011 | Iwaya et al. | 399/323 |
| 2011/0217056 | A1 | 9/2011 | Yoshinaga et al. | 399/33 |
| 2011/0217057 | A1 | 9/2011 | Yoshinaga et al. | 399/77 |
| 2011/0217093 | A1 | 9/2011 | Tokuda et al. | 399/329 |
| 2011/0217095 | A1 | 9/2011 | Ishii et al. | 399/329 |
| 2011/0222875 | A1 | 9/2011 | Imada et al. | 399/33 |
| 2011/0222888 | A1 | 9/2011 | Ikebuchi et al. | 399/69 |
| 2011/0222926 | A1 | 9/2011 | Ueno et al. | 399/328 |
| 2011/0222929 | A1 | 9/2011 | Fujimoto et al. | 399/329 |
| 2011/0222930 | A1 | 9/2011 | Fujimoto et al. | 399/329 |
| 2011/0222931 | A1 | 9/2011 | Shinshi et al. | 399/329 |
| 2011/0229178 | A1 | 9/2011 | Ogawa et al. | 399/67 |
| 2011/0229181 | A1 | 9/2011 | Iwaya et al. | 399/69 |
| 2011/0229200 | A1 | 9/2011 | Yamaguchi et al. | 399/122 |
| 2011/0229225 | A1 | 9/2011 | Ishii et al. | 399/329 |
| 2011/0229226 | A1 | 9/2011 | Tokuda et al. | 399/329 |
| 2011/0229227 | A1 | 9/2011 | Yoshikawa et al. | 399/329 |
| 2011/0229228 | A1 | 9/2011 | Yoshikawa et al. | 399/329 |

FOREIGN PATENT DOCUMENTS

| | | | |
|---|---|---|---|
| JP | 2007-334205 | | 12/2007 |
| JP | 2008-292760 | A * | 12/2008 |
| JP | 2010-020129 | A * | 1/2010 |
| JP | 2010-96782 | | 4/2010 |

OTHER PUBLICATIONS

U.S. Appl. No. 13/110,133, filed May 18, 2011, Hiroshi Yoshinaga.

U.S. Appl. No. 13/097,711, filed Apr. 29, 2011, Toshihiko Shimokawa, et al.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-251000, filed on Nov. 9, 2010, in the Japan Patent Office, the entire disclosure of which is hereby incorporated by reference herein.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers, having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ an endless belt-shaped fixing film, a heater disposed inside a loop formed by the fixing film, and a pressing roller pressed against the heater via the fixing film to form a fixing nip between the pressing roller and the fixing film through which the recording medium bearing the toner image passes. As the recording medium passes through the fixing nip, the fixing film heated by the heater and the pressing roller together apply heat and pressure to the recording medium, thus melting and fixing the toner image on the recording medium.

FIG. 1 is a vertical sectional view of a fixing device 20R having such configuration. For example, a pressing roller 106 is pressed against a heater 103 via a fixing film 102 to form a fixing nip N1 between the pressing roller 106 and the fixing film 102 through which a recording medium bearing a toner image passes. Since the toner image formed on the recording medium contacts the fixing film 102 as the recording medium is conveyed through the fixing nip N1, the recording medium tends to adhere to the fixing film 102 due to an adhesive force of heated toner of the toner image formed on the recording medium after it is discharged from the fixing nip N1. Otherwise, the recording medium may be wound around the pressing roller 106 due to its curvature. To address this problem, the technology described below is used to facilitate separation of the recording medium from the fixing film 102 and the pressing roller 106.

For example, the fixing device 20R further includes a heater holder 104 that holds the heater 103 and includes a protrusion 104*a* protruding toward the pressing roller 106 and contacting the inner circumferential surface of the fixing film 102 so as to prevent the recording medium from adhering to the fixing film 102. A pair of rollers 107 and 108 is disposed downstream from the fixing nip N1 in a conveyance direction of the recording medium to form a post-fixing nip N2 between the rollers 107 and 108. These components of the fixing device 20R are arranged as described below to facilitate separation of the recording medium from the fixing film 102 and the pressing roller 106.

A straight line La connects a downstream edge of the fixing nip N1 in the conveyance direction of the recording medium and the summit of the protrusion 104*a*. A straight line Lb connects the summit of the protrusion 104*a* and the post-fixing nip N2. A straight line Ln extends along a sectional line of the fixing nip N1. An angle θ2 formed by the straight line Lb and the straight line Ln is greater than an angle θ1 that is formed by the straight La and the straight line Ln and is greater than 5 degrees. With this configuration, even the moisture-laden recording medium can be conveyed precisely without adhering to the pressing roller 106.

However, the configuration shown in FIG. 1 has a drawback in that since the angle θ1 is greater than 5 degrees, the recording medium, when bearing a color toner image on both sides thereof, may be wound around the pressing roller 106 readily. Additionally, the protrusion 104*a* protrudes toward the pressing roller 106 from the heater holder 104 that guides the recording medium toward the pressing roller 106 in such a manner that the recording medium is beyond the straight line Ln toward the pressing roller 106. Accordingly, if the length of the fixing nip N1 in the conveyance direction of the recording medium is elongated due to variation in the hardness of the pressing roller 106 and pressure applied from the pressing roller 106 to the fixing film 102, the angle θ1 may increase rapidly, thus rendering the recording medium wound around the pressing roller 106.

BRIEF SUMMARY OF THE INVENTION

This specification describes below an improved fixing device for fixing a toner image on a recording medium. In one exemplary embodiment of the present invention, the fixing device includes a flexible endless fixing belt formed into a loop; a pressing rotary body disposed outside the loop formed by the fixing belt; a nip formation pad disposed inside the loop formed by the fixing belt and pressed against the pressing rotary body via the fixing belt to form a fixing nip between the pressing rotary body and the fixing belt through which the recording medium bearing the toner image is conveyed. The nip formation pad includes a protrusion disposed downstream from the fixing nip in a conveyance direction of the recording medium and protruding toward the pressing rotary body without contacting the pressing rotary body. The fixing device further includes a pressing rotary body mover to contact and move the pressing rotary body bidirectionally in the conveyance direction of the recording medium to move the fixing nip toward and away from the protrusion.

This specification further describes an improved image forming apparatus. In one exemplary embodiment, the image forming apparatus includes an image forming device to form a toner image on a recording medium according to image data and the fixing device described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
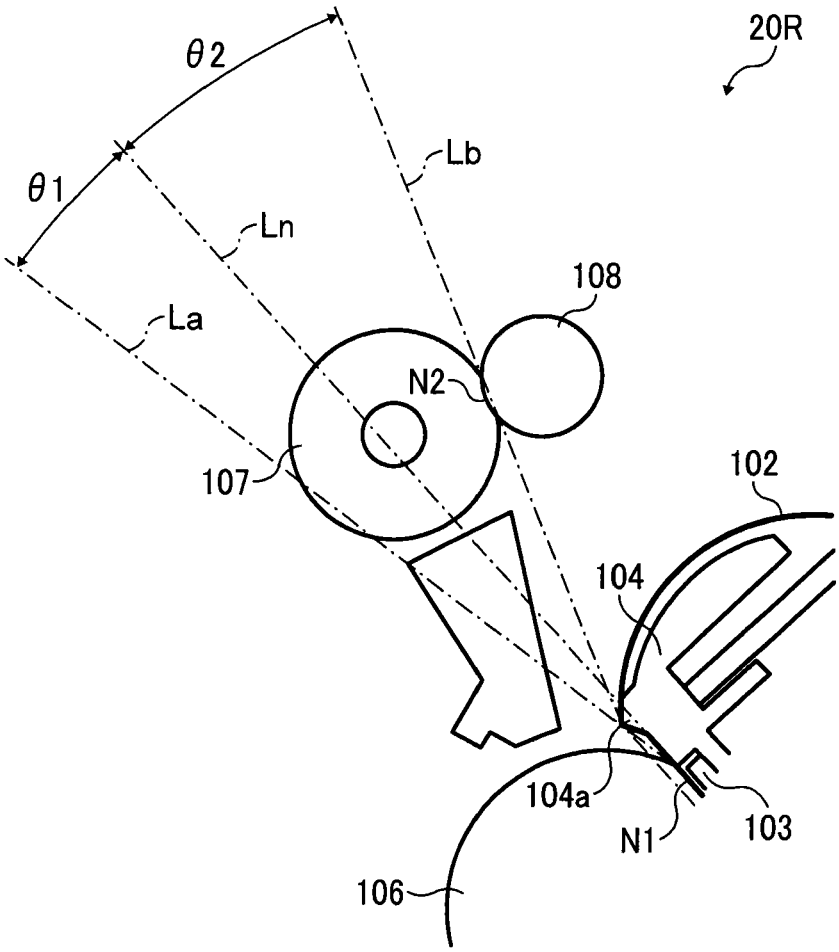
FIG. 1 RELATED ART
FIG. 1 is a vertical sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
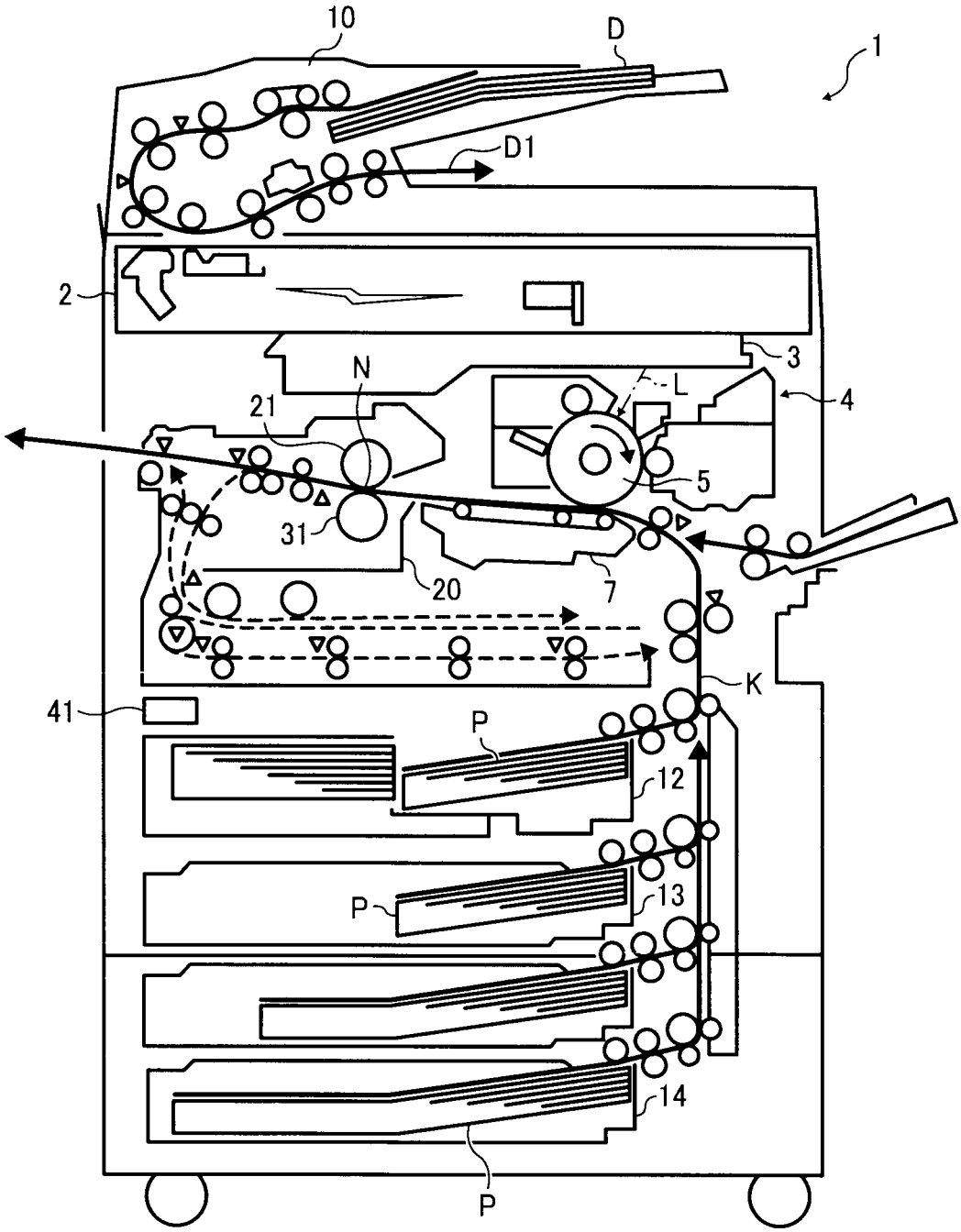
FIG. 2 is a schematic sectional view of an image forming apparatus according to an exemplary embodiment of the present invention.

Referring now to the drawings, wherein like reference numerals designate identical or corresponding parts throughout the several views, in particular to FIG. 2, an image forming apparatus 1 according to an exemplary embodiment of the present invention is explained.

FIG. 2 is a schematic sectional view of the image forming apparatus 1. As illustrated in FIG. 2, the image forming apparatus 1 may be a copier, a facsimile machine, a printer, a multifunction printer having at least one of copying, printing, scanning, plotter, and facsimile functions, or the like. According to this exemplary embodiment, the image forming apparatus 1 is a copier for forming an image on a recording medium by electrophotography.

Referring to FIG. 2, the following describes the structure of the image forming apparatus 1.

As illustrated in FIG. 2, the image forming apparatus 1 includes an auto document feeder 10 disposed atop the image forming apparatus 1; an original document reader 2 disposed in an upper portion of the image forming apparatus 1; an exposure device 3 disposed below the original document reader 2; an image forming device 4 disposed below the exposure device 3; a transfer device 7 disposed below the image forming device 4; paper trays 12, 13, and 14 disposed below the transfer device 7 in a lower portion of the image forming apparatus 1 and containing a plurality of recording media P (e.g., transfer sheets); and a fixing device 20 disposed downstream from the transfer device 7 in a conveyance direction of a recording medium P.

The auto document feeder 10 feeds an original document D to the original document reader 2 that optically reads an image on the original document D to generate image data. The exposure device 3 emits light L onto a photoconductive drum 5 of the image forming device 4 according to the image data sent from the original document reader 2 to form an electrostatic latent image on the photoconductive drum 5. Then, the image forming device 4 visualizes the electrostatic latent image formed on the photoconductive drum 5 as a toner image. The transfer device 7 transfers the toner image formed on the photoconductive drum 5 onto a recording medium P sent from one of the paper trays 12 to 14. The fixing device 20 fixes the toner image on the recording medium P.

Referring to FIG. 2, the following describes the operation of the image forming apparatus 1 having the above-described structure to form a toner image on a recording medium P.

Conveyance rollers of the auto document feeder 10 convey an original document D placed on an original document tray in a direction D1 over the original document reader 2. As the original document D passes over the original document reader 2, the original document reader 2 optically reads an image on the original document D.

For example, the original document reader 2 converts the read image into electric signals and then sends the electric signals to the exposure device 3. The exposure device 3 emits light L (e.g., a laser beam) onto the photoconductive drum 5 according to the electric signals sent from the original document reader 2, thus serving as a writer that forms an electrostatic latent image on the photoconductive drum 5.

The image forming device 4 performs a series of image forming processes including a charging process, an exposure process, and a development process on the photoconductive drum 5 as the photoconductive drum 5 rotates clockwise in FIG. 2. For example, a charger charges a surface of the photoconductive drum 5 in the charging process. The exposure device 3 emits light L onto the charged surface of the photoconductive drum 5 to form an electrostatic latent image thereon as described above in the exposure process. A development device visualizes the electrostatic latent image formed on the photoconductive drum 5 as a toner image in the development process. Thereafter, the transfer device 7 transfers the toner image formed on the photoconductive drum 5 onto a recording medium P sent from one of the paper trays 12 to 14 through a registration roller pair.

A detailed description is now given of the recording medium P sent to the transfer device 7.

One of the paper trays 12 to 14 is selected automatically according to the image data generated by the original document reader 2 or manually by a user using a control panel disposed atop the image forming apparatus 1. According to the description below, the uppermost paper tray 12 is selected. An uppermost recording medium P of the plurality of recording media P contained in the paper tray 12 is sent toward the registration roller pair through a conveyance path K.

Thereafter, the recording medium P reaches the registration roller pair. The registration roller pair temporarily stops the recording medium P, and then feeds the recording medium P to a transfer nip formed between the photoconductive drum 5 and the transfer device 7 at a time when the toner image formed on the photoconductive drum 5 is transferred onto the recording medium P.

After the transfer device 7 transfers the toner image onto the recording medium P, the recording medium P bearing the toner image is sent to the fixing device 20 through the conveyance path K. As the recording medium P bearing the toner image passes through a fixing nip N formed between a fixing belt 21 and a pressing roller 31 of the fixing device 20, the fixing belt 21 heats the recording medium P and at the same time the pressing roller 31 and the fixing belt 21 together apply pressure to the recording medium P, thus fixing the toner image on the recording medium P. After the recording medium P bearing the fixed toner image is discharged from the fixing nip N, the recording medium P is discharged onto an outside of the image forming apparatus 1. Thus, a series of image forming processes performed by the image forming apparatus 1 is completed.

Figure 3:
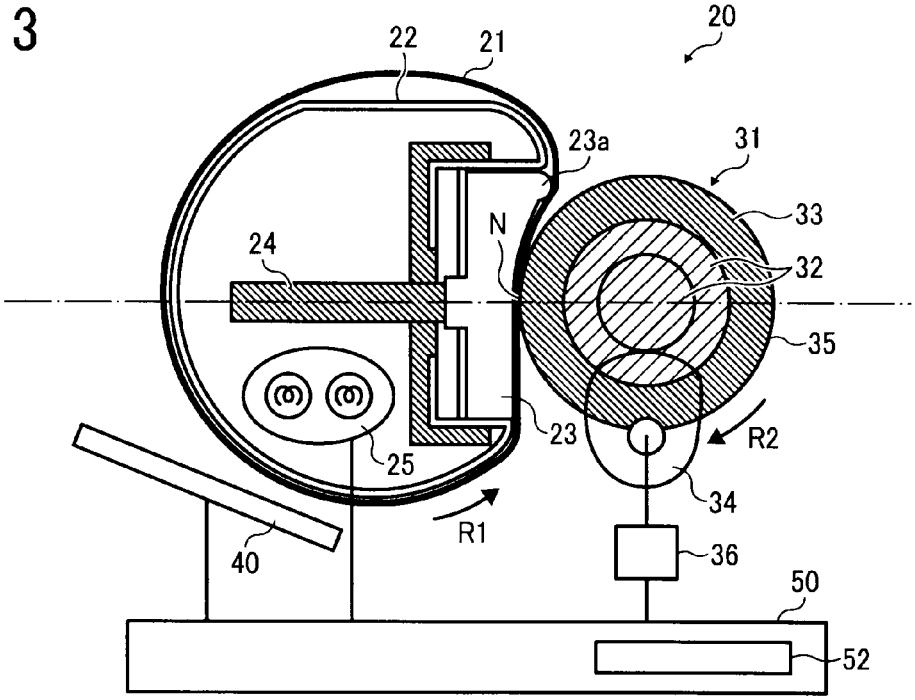
FIG. 3 is a vertical sectional view of a fixing device included in the image forming apparatus shown in FIG. 2 in a state in which a pressing roller included in the fixing device is at a first position.
Figure 4:
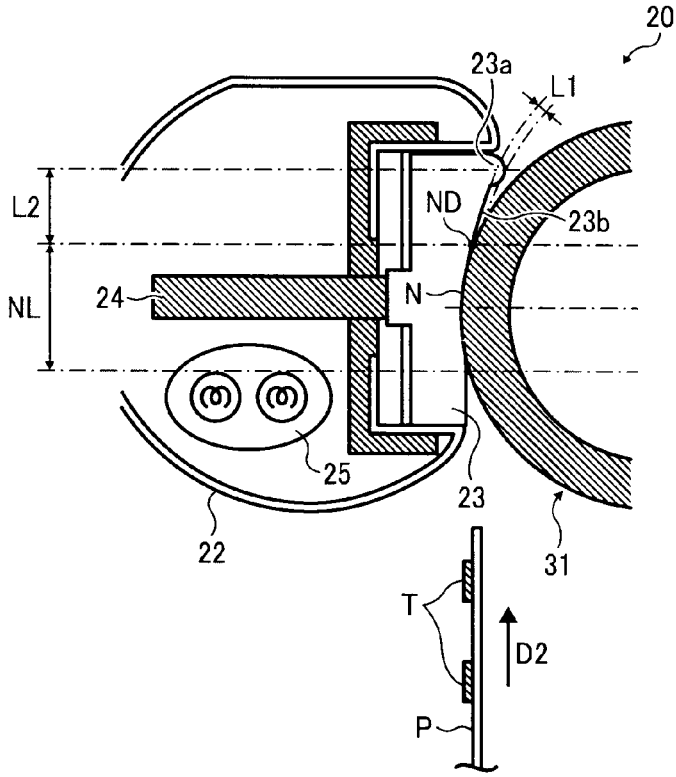
FIG. 4 is a partially enlarged sectional view of the fixing device shown in FIG. 3.

Referring to FIGS. 3 and 4, the following describes the structure and operation of the fixing device 20 installed in the image forming apparatus 1 described above.

FIG. 3 is a vertical sectional view of the fixing device 20. FIG. 4 is a partially enlarged sectional view of the fixing device 20. As illustrated in FIG. 3, the fixing device 20 includes the fixing belt 21; a metal thermal conductor 22, a nip formation pad 23, a support 24, and a heater 25 disposed inside a loop formed by the fixing belt 21; and the pressing roller 31 and a temperature sensor 40 disposed outside the loop formed by the fixing belt 21.

A detailed description is now given of the fixing belt 21.

The fixing belt 21, serving as a fixing rotary body, may be a thin, flexible endless belt that rotates counterclockwise in FIG. 3 in a rotation direction R1. For example, a driver (e.g., a motor) connected to the pressing roller 31 rotates the pressing roller 31 clockwise in FIG. 3 in a rotation direction R2, and the rotating pressing roller 31 rotates the fixing belt 21 by friction therebetween in the rotation direction R1 counter to the rotation direction R2 of the pressing roller 31.

The fixing belt 21 is constructed of a base layer, an elastic layer disposed on the base layer, and a release layer disposed on the elastic layer, and has a total thickness not greater than about 1 mm. The base layer of the fixing belt 21, having a thickness in a range of from about 30 micrometers to about 50 micrometers, is made of a metal material such as nickel and stainless steel and/or a resin material such as polyimide.

The elastic layer of the fixing belt 21, having a thickness in a range of from about 100 micrometers to about 300 micrometers, is made of a rubber material such as silicone rubber, silicone rubber foam, and fluorocarbon rubber. The elastic layer eliminates or reduces slight surface asperities of the fixing belt 21 at the fixing nip N formed between the fixing belt 21 and the pressing roller 31. Accordingly, heat is uniformly conducted from the fixing belt 21 to a toner image T on a recording medium P, minimizing formation of a rough image such as an orange peel image.

The release layer of the fixing belt 21, having a thickness in a range of from about 10 micrometers to about 50 micrometers, is made of tetrafluoroethylene perfluoroalkylvinylether copolymer (PFA), polyimide, polyetherimide, and/or polyether sulfide (PES). The release layer releases or separates the toner image T on the recording medium P from the fixing belt 21.

According to this exemplary embodiment, the fixing belt 21 has a loop diameter of about 30 mm. The heater 25, the metal thermal conductor 22, the nip formation pad 23, and the support 24 are fixedly provided inside the loop formed by the fixing belt 21 in such a manner that they face an inner circumferential surface of the fixing belt 21.

A detailed description is now given of the support 24.

The support 24 is fixedly provided inside the loop formed by the fixing belt 21 to support the nip formation pad 23 that presses against the pressing roller 31 via the fixing belt 21 to form the fixing nip N between the pressing roller 31 and the fixing belt 21. The support 24 presses against the pressing roller 31 via the nip formation pad 23 and the fixing belt 21, preventing the nip formation pad 23 from being deformed and bent by pressure from the pressing roller 31 at the fixing nip N.

It is preferable that the support 24 is made of a metal material having a relatively greater mechanical strength, such as stainless steel and iron, so as to support the nip formation pad 23 precisely. Further, the support 24 may have a greater thickness in cross-section in a pressing direction in which the pressing roller 31 presses against the support 24. Accordingly, the support 24 may have a greater section modulus that increases its mechanical strength.

A detailed description is now given of the metal thermal conductor 22.

The heater 25 serving as a heat source is a halogen heater having lateral ends in a longitudinal direction thereof parallel to an axial direction of the fixing belt 21 fixedly mounted on side plates of the fixing device 20, respectively. Radiation heat generated by the heater 25, which is controlled by a power supply of the image forming apparatus 1 depicted in FIG. 2, heats the metal thermal conductor 22. The metal thermal conductor 22 heats substantially the entire fixing belt 21. Accordingly, heat is conducted from an outer circumferential surface of the heated fixing belt 21 to the toner image T on the recording medium P. The temperature sensor 40 (e.g., a thermistor) disposed opposite the outer circumferential surface of the fixing belt 21 detects a temperature of the outer circumferential surface of the fixing belt 21. A controller 50 operatively connected to the temperature sensor 40 and the heater 25 controls the heater 25 based on the temperature of the fixing belt 21 detected by the temperature sensor 40 so as to adjust the temperature (e.g., a fixing temperature) of the fixing belt 21 to a desired temperature.

The metal thermal conductor 22 is fixedly provided inside the loop formed by the fixing belt 21 in such a manner that the metal thermal conductor 22 is disposed opposite the inner circumferential surface of the fixing belt 21 at a region other than a region forming the fixing nip N. As radiation heat generated by the heater 25 heats the metal thermal conductor 22, the metal thermal conductor 22 conducts the heat to the fixing belt 21.

The metal thermal conductor 22 is made of a thermal conductive material such as aluminum, iron, and stainless steel. According to this exemplary embodiment, the metal thermal conductor 22 is made of SUS stainless steel having a relatively greater mechanical strength.

With the above-described configuration, the metal thermal conductor 22 heats substantially the entire fixing belt 21 in a circumferential direction thereof. Accordingly, even if the fixing belt 21 rotates at a high speed, the fixing belt 21 is heated to the fixing temperature quickly, preventing faulty fixing due to a lower temperature of the fixing belt 21.

Even with the thinner metal thermal conductor 22 that enhances heating efficiency of the fixing belt 21, the metal thermal conductor 22 separately provided from the nip formation pad 23 that receives pressure from the pressing roller 31 does not receive the pressure from the pressing roller 31, preventing flexure and deflection of the metal thermal conductor 22 that may cause scratching over the inner circumferential surface of the fixing belt 21 and increasing of driving torque of the fixing belt 21.

As described above, the metal thermal conductor 22 does not heat a part of the fixing belt 21 but does heat substantially the entire fixing belt 21 in the circumferential direction thereof. Accordingly, even if the fixing belt 21 rotates at a high speed, the fixing belt 21 is heated to the fixing temperature quickly, preventing faulty fixing. That is, with the relatively simple configuration of the fixing device 20 described above, the fixing belt 21 is heated efficiently, thus shortening a warm-up time and a first print time required to start a fixing operation after the image forming apparatus 1 is powered on and downsizing the fixing device 20.

A differential between an outer diameter of the fixing belt 21 and an outer diameter of the metal thermal conductor 22 is not greater than about 1 mm. Accordingly, the fixing belt 21 slides over the metal thermal conductor 22 within a minimized area, minimizing wear of the fixing belt 21 and at the same time minimizing a gap between the metal thermal conductor 22 and the fixing belt 21, thus maintaining heating efficiency of the fixing belt 21. The metal thermal conductor 22 disposed in proximity to the fixing belt 21 maintains a circular shape of the flexible fixing belt 21, reducing degradation and damage of the fixing belt 21 due to its deformation.

An outer circumferential surface of the metal thermal conductor 22 over which the fixing belt 21 slides may be made of a material having a smaller friction coefficient to reduce wear of the fixing belt 21 due to friction between the metal thermal conductor 22 and the fixing belt 21 sliding over the metal thermal conductor 22.

A detailed description is now given of the pressing roller 31.

The pressing roller 31 serving as a pressing rotary body with a diameter of about 30 mm is constructed of a hollow metal core 32, an elastic layer 33 disposed on the metal core 32, and a release layer 35 optionally disposed on the elastic layer 33. The elastic layer 33 is made of silicone rubber foam, silicone rubber, and/or fluorocarbon rubber. The thin release layer 35 constituting an outer surface layer is made of PFA and/or polytetrafluoroethylene (PTFE). The pressing roller 31 is pressed against the nip formation pad 23 via the fixing belt 21 to form the fixing nip N between the pressing roller 31 and the fixing belt 21.

With the elastic layer 33 of the pressing roller 31 made of a sponge material such as silicone rubber foam, the pressing roller 31 applies decreased pressure to the fixing belt 21 at the fixing nip N, thus decreasing bending of the metal thermal conductor 22.

According to this exemplary embodiment, the loop diameter of the fixing belt 21 is equivalent to that of the pressing roller 31. Alternatively, the loop diameter of the fixing belt 21 may be smaller than that of the pressing roller 31. In this case, a curvature of the fixing belt 21 is greater than that of the pressing roller 31 at the fixing nip N, facilitating separation of a recording medium P from the fixing belt 21 when the recording medium P is discharged from the fixing nip N.

Referring to FIGS. 3 and 4, a detailed description is now given of the nip formation pad 23.

The nip formation pad 23 fixedly provided inside the fixing belt 21 is pressed against the pressing roller 31 via the fixing belt 21 to form the fixing nip N between the fixing belt 21 and the pressing roller 31. An outer circumferential surface of the nip formation pad 23 over which the fixing belt 21 slides may be made of a material having a smaller friction coefficient to reduce wear of the fixing belt 21 due to friction between the nip formation pad 23 and the fixing belt 21 sliding over the nip formation pad 23.

As shown in FIG. 4, the nip formation pad 23 includes a protrusion 23*a* protruding toward the pressing roller 31 at a position downstream from the fixing nip N having a nip length NL in a conveyance direction D2 of the recording medium P. The protrusion 23*a* extends throughout an entire width thereof corresponding to a width of the recording medium P in a longitudinal direction of the protrusion 23*a* parallel to the axial direction of the fixing belt 21.

The nip formation pad 23 further includes an arcuate recess 23*b* disposed downstream from the fixing nip N and upstream from the protrusion 23*a* in the conveyance direction D2 of the recording medium P. The arcuate recess 23*b* has an arcuate shape corresponding to the curvature of the pressing roller 31. For example, a curvature of the arcuate recess 23*b* that corresponds to the curvature of the pressing roller 31 is in a range of from about R25 to about R60 with a curvature radius in a range of from about 25 mm to about 60 mm. According to this exemplary embodiment, the curvature of the arcuate recess 23*b* is about R60. With the above-described configuration, the arcuate recess 23*b* reduces bending of the fixing belt 21 caused by the protrusion 23*a*, extending the life of the fixing belt 21.

The protrusion 23*a* is shifted from a virtual circle drawn by the arcuate recess 23*b* having the above-described curvature toward the pressing roller 31 in a direction perpendicular to the conveyance direction D2 of the recording medium P by a length L1 in a range of from about 0.1 mm to about 0.2 mm. The protrusion 23*a* is at a position downstream from a downstream end ND of the fixing nip N in the conveyance direction D2 of the recording medium P by a length L2 in a range of from about 1.0 mm to about 2.0 mm.

With the above-described configuration, even when a thin recording medium P is discharged from the fixing nip N, the protrusion 23*a* prevents the recording medium P from adhering to the fixing belt 21. Further, even when a recording medium P bearing a toner image on both sides of the recording medium P in duplex printing is discharged from the fixing nip N, the protrusion 23*a* prevents the recording medium P from adhering to the pressing roller 31.

Figure 5:
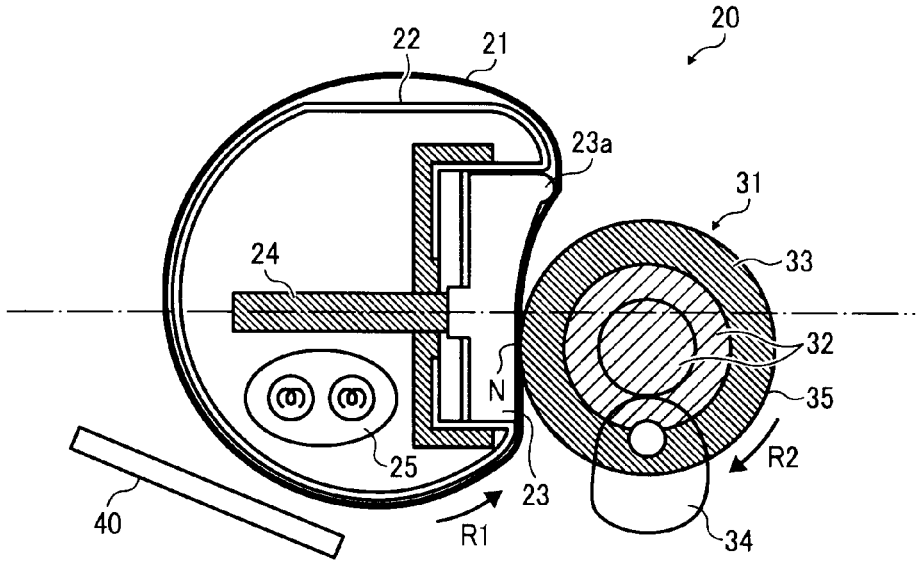
FIG. 5 is a vertical sectional view of the fixing device shown in FIG. 3 in a state in which the pressing roller is at a second position.

Referring to FIGS. 3 and 5, a detailed description is now given of a cam 34 of the fixing device 20.

FIG. 5 is a vertical sectional view of the fixing device 20. The protrusion 23*a* of which position and height is adjusted as described above can facilitate separation of the recording medium P from the fixing belt 21 and at the same time prevent the recording medium P from adhering to the pressing roller 31. However, if the fixing nip N moves closer to the protrusion 23*a*, the recording medium P may adhere to the pressing roller 31 readily. Additionally, the protrusion 23*a* rubs against the fixing belt 21, increasing frictional resistance between the protrusion 23*a* and the fixing belt 21 sliding over the protrusion 23*a*. For example, while the fixing device 20 is warmed up and therefore grease applied to the fixing belt 21 has a relatively low temperature, the fixing belt 21 may slip over the nip formation pad 23.

To address this problem, the fixing device 20 according to this exemplary embodiment includes the cam 34 disposed on each lateral end of the metal core 32 of the pressing roller 31 in an axial direction of the pressing roller 31. As the cam 34 rotates, it changes the position of the pressing roller 31 so as to change the position of the fixing nip N, that is, a center portion of a region where the pressing roller 31 presses against the nip formation pad 23 via the fixing belt 21 in the conveyance direction D2 of the recording medium P. Thus, the cam 34 serves as a pressing rotary body mover that moves the pressing roller 31 serving as a pressing rotary body.

The cam 34 contacts the metal core 32 of the pressing roller 31. A driver 36 (e.g., a stepping motor) rotates the cam 34 in an arbitrary rotation amount. A biasing member (e.g., a combination of an arm and a spring) disposed at an upper position in FIG. 3 where it is disposed opposite the cam 34 via the metal core 32 presses the metal core 32 against the cam 34.

When the cam 34 is at a first position shown in FIG. 3, the pressing roller 31 moves upward in FIG. 3 to a position disposed in proximity to the protrusion 23*a*. Accordingly, the fixing nip N is most proximate to the protrusion 23*a*, maximizing separation of the recording medium P from the fixing belt 21. For example, the positional relation between the protrusion 23*a* and the fixing nip N shown in FIG. 3 is suitable for thin recording media P.

By contrast, when the cam 34 is at a second position shown in FIG. 5, the pressing roller 31 moves downward in FIG. 5 to a position disposed away from the protrusion 23*a*. Accordingly, the fixing nip N is isolated farthest from the protrusion 23*a*, minimizing rubbing of the fixing belt 21 by the protrusion 23*a* and frictional resistance between the nip formation pad 23 and the fixing belt 21 sliding over the nip formation pad 23.

According to the fixing device 20 described above, a distance between the fixing nip N and the protrusion 23*a* is adjustable according to the circumstances. For example, when a thin recording medium P is used, the cam 34 moves the pressing roller 31 to the first position shown in FIG. 3 where a decreased distance is provided between the fixing nip N and the protrusion 23*a*, thus facilitating separation of the thin recording medium P from the fixing belt 21. By contrast, when grease applied between the fixing belt 21 and the nip formation pad 23 is not yet heated to a desired temperature, for example, while the fixing device 20 is warmed up, the cam 34 moves the pressing roller 31 to the second position shown in FIG. 5 where an increased distance is provided between the fixing nip N and the protrusion 23*a*, thus decreasing frictional resistance between the nip formation pad 23 and the fixing belt 21 sliding over the nip formation pad 23.

The cam 34 is used as a pressing rotary body mover that moves the pressing roller 31. That is, the simple configuration using the cam 34 adjusts the distance between the fixing nip N and the protrusion 23*a*.

A detailed description is now given of the operation of the fixing device 20.

While the fixing device 20 is warmed up, the cam 34 moves the pressing roller 31 to the second position shown in FIG. 5 where the increased distance is provided between the fixing nip N and the protrusion 23*a*. While the pressing roller 31 rotates in the rotation direction R2, the controller 50 depicted in FIG. 3 turns on the heater 25 to heat the metal thermal conductor 22 and the fixing belt 21. When the controller 50 determines that the temperature of the fixing belt 21 detected by the temperature sensor 40 reaches a predetermined temperature T1, the controller 50 finishes warming up and a recording medium P is conveyed to the fixing nip N.

While the fixing device 20 is warmed up, grease applied between the fixing belt 21 and the nip formation pad 23 is not yet heated to a desired temperature and therefore the fixing belt 21 slides over the nip formation pad 23 with a relatively greater frictional resistance therebetween. Accordingly, the cam 34 moves the pressing roller 31 to the second position shown in FIG. 5 where the increased distance is provided between the fixing nip N and the protrusion 23*a*, decreasing frictional resistance between the fixing belt 21 and the nip formation pad 23 and therefore preventing slippage of the fixing belt 21.

If the controller 50 receives a print job to form a toner image T on a thin recording medium P having a thickness smaller than a predetermined thickness, the controller 50 causes the driver 36 to rotate the cam 34 to move the pressing roller 31 toward the protrusion 23*a* to the first position shown in FIG. 3 where the decreased distance is provided between the fixing nip N and the protrusion 23*a*. Thereafter, the recording medium P enters the fixing nip N.

By contrast, if the controller 50 receives a print job to form a toner image T on a thick recording medium P having a thickness not smaller than the predetermined thickness, the controller 50 causes the driver 36 to rotate the cam 34 to move the pressing roller 31 away from the protrusion 23*a* to the second position shown in FIG. 5 where the increased distance is provided between the fixing nip N and the protrusion 23*a*. Thereafter, the recording medium P enters the fixing nip N.

When the thick recording medium P passes through the fixing nip N, the thick recording medium P may cause the protrusion 23*a* to rub the fixing belt 21 and thus increase frictional resistance between the protrusion 23*a* of the nip formation pad 23 and the fixing belt 21 sliding over the nip formation pad 23. To address this problem, the cam 34 moves the pressing roller 31 to the second position shown in FIG. 5 where the increased distance is provided between the fixing nip N and the protrusion 23*a*, decreasing frictional resistance between the protrusion 23*a* and the fixing belt 21 sliding over the nip formation pad 23 and thus preventing slippage of the fixing belt 21.

It is to be noted that the thick recording medium P has a rigidity large enough to separate itself from the fixing belt 21 even if the substantial distance is provided between the fixing nip N and the protrusion 23*a*.

Similarly, if an envelope is used as a recording medium P, the cam 34 moves the pressing roller 31 to the second position shown in FIG. 5 where the increased distance is provided between the fixing nip N and the protrusion 23*a*. Since the fixing nip N disposed away from the protrusion 23*a* decreases frictional resistance between the nip formation pad 23 and the fixing belt 21 sliding over the nip formation pad 23, a differential between a rotation speed of the fixing belt 21 and a rotation speed of the pressing roller 31 may not arise. Accordingly, the fixing belt 21 contacting a front side of the envelope and the pressing roller 31 contacting a back side of the envelope convey the envelope at an identical speed without creasing the envelope.

According to this exemplary embodiment, the predetermined thickness, that is, a threshold value, of the recording medium P is about 120 micrometers. Alternatively, the predetermined thickness may vary depending on the paper type mode available in the image forming apparatus 1 (e.g., a thin paper mode, a plain paper mode, and a thick paper mode). Further, since separation of the recording medium P from the fixing belt 21 is influenced by ambient temperature and humidity, the predetermined thickness may vary depending on the ambient temperature and humidity.

For example, as shown in FIG. 2, the image forming apparatus 1 includes a thermohygrometer 41 serving as a detector that detects the ambient temperature and humidity of the image forming apparatus 1. When the ambient temperature and humidity detected by the thermohygrometer 41 exceeds a predetermined value, the cam 34 moves the pressing roller 31 to the first position shown in FIG. 3 where the decreased distance is provided between the fixing nip N and the protrusion 23*a*, and then the recording medium P enters the fixing nip N.

Separation of the recording medium P from the fixing belt 21 is also influenced by an amount of toner adhered to the recording medium P. For example, as more toner is adhered to a leading edge of the recording medium P in the conveyance direction D2 of the recording medium P, it becomes difficult for the recording medium P to separate from the fixing belt 21. Therefore, the recording medium P is more likely to be adhered to and wound around the fixing belt 21. To address this problem, as shown in FIG. 3, the controller 50 includes an image pattern detector 52 that detects an image pattern (e.g., a text image, a solid image, and a photographic image) contained in image data of a print job received by the image forming apparatus 1. If the image pattern detector 52 detects that the amount of toner adhered to the leading edge of the recording medium P is greater than a predetermined value, the controller 50 causes the cam 34 to move the pressing roller 31 to the first position shown in FIG. 3 where the decreased distance is provided between the fixing nip N and the protrusion 23*a*. Thereafter, the recording medium P enters the fixing nip N.

It is to be noted that the cam 34 can move the pressing roller 31 either while the pressing roller 31 rotates or while the pressing roller 31 stops.

If the image forming apparatus 1 receives the same print jobs continuously, the cam 34 does not move the pressing roller 31 for a predetermined time after the last recording medium P of the previous print job is discharged from the fixing nip N, saving time required to move the pressing roller 31. Thus, the positional relation between the protrusion 23*a* and the pressing roller 31 is maintained after the last recording medium P of the previous print job is discharged from the fixing nip N until the first recording medium P of the subsequent print job enters the fixing nip N.

The image forming apparatus 1 installed with the fixing device 20 having the above-described configuration provides the advantages described above.

The present invention is not limited to the details of exemplary embodiments described above, and various modifications and improvements are possible.

For example, the fixing device 20 shown in FIG. 3 uses a halogen heater, that is, the heater 25, as a heat source. Alternatively, other heaters may be used as a heat source.

Figure 6:
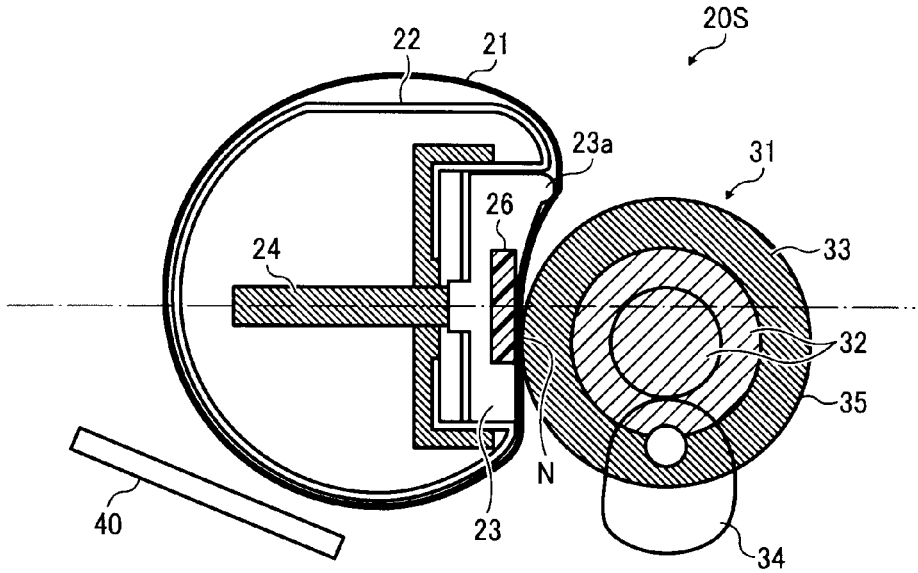
FIG. 6 is a vertical sectional view of a fixing device according to another exemplary embodiment of the present invention.

FIG. 6 is a vertical sectional view of a fixing device 20S installed with a ceramic heater 26 as a heat source that heats the fixing belt 21. The ceramic heater 26 is disposed opposite the pressing roller 31 at the fixing nip N. Unlike the heater 25 shown in FIG. 3 that heats the fixing belt 21 via the metal thermal conductor 22, the ceramic heater 26 directly heats the fixing belt 21.

Figure 7:
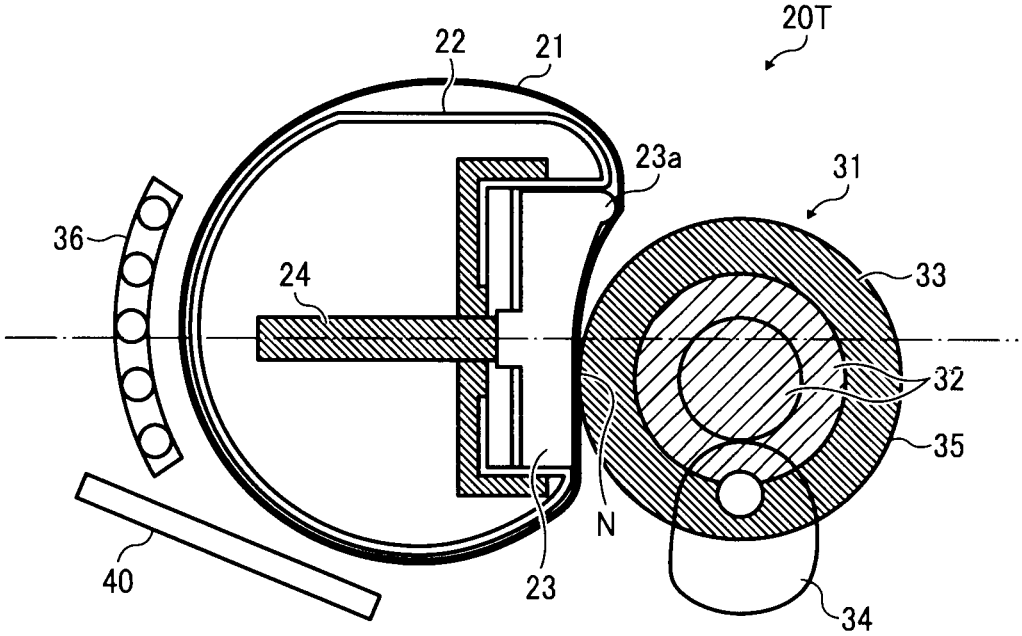
FIG. 7 is a vertical sectional view of a fixing device according to yet another exemplary embodiment of the present invention.

FIG. 7 is a vertical sectional view of a fixing device 20T installed with an induction heater 36 as a heat source that heats the fixing belt 21. The induction heater 36 is disposed outside the loop formed by the fixing belt 21 and includes an exciting coil that generates a magnetic flux to heat the fixing belt 21 by electromagnetic induction.

The fixing devices 20, 20S, and 20T use the pressing roller 31 as the pressing rotary body. Alternatively, the pressing roller 31 may be replaced by a support roller over which a pressing belt is looped.

Referring to FIGS. 2 to 7, the following describes the advantages of the fixing devices 20, 20S, and 20T.

As described above, the fixing devices 20, 20S, and 20T include a flexible endless belt-shaped fixing rotary body (e.g., the fixing belt 21); a pressing rotary body (e.g., the pressing roller 31) disposed outside the loop formed by the fixing rotary body and pressed against the fixing rotary body; the nip formation pad 23 disposed inside the loop formed by the fixing rotary body and pressed against the pressing rotary body via the fixing rotary body to form the fixing nip N between the pressing rotary body and the fixing rotary body. The nip formation pad 23 includes the protrusion 23*a* disposed downstream from the fixing nip N in the conveyance direction D2 of the recording medium P and protruding toward the pressing rotary body via the fixing rotary body without pressing against the pressing rotary body. The fixing devices 20, 20S, and 20T further include a pressing rotary body mover (e.g., the cam 34) that moves the pressing rotary body to move a center of the fixing nip N in the conveyance direction D2 of the recording medium P toward and away from the protrusion 23*a*. With this configuration, the fixing devices 20, 20S, and 20T facilitate separation of the recording medium P from the fixing rotary body and the pressing rotary body and prevent slippage of the fixing rotary body, resulting in formation of a high quality toner image T on the recording medium P.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible endless fixing belt formed into a loop;

a pressing rotary body disposed outside the loop formed by the fixing belt;

a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body; and a pressing rotary body mover to contact and move the pressing rotary body bidirectionally in the conveyance direction of the recording medium to move the fixing nip toward and away from the protrusion;

wherein the pressing rotary body is pressed against the pressing rotary body mover from a direction opposite to the conveyance direction.

2. The fixing device according to claim 1, wherein the pressing rotary body includes a pressing roller.

3. The fixing device according to claim 1, wherein the pressing rotary body mover includes a cam.

4. The fixing device according to claim 1, wherein the pressing rotary body mover moves the pressing rotary body to a first position where the fixing nip is disposed in proximity to the protrusion when the recording medium has a thickness smaller than a predetermined thickness.

5. The fixing device according to claim 1, wherein the pressing rotary body mover moves the pressing rotary body to a second position where the fixing nip is away from the protrusion while the fixing device is warmed up.

6. The fixing device according to claim 1, wherein the pressing rotary body mover moves the pressing rotary body to a second position where the fixing nip is away from the protrusion when the recording medium has a thickness not smaller than a predetermined thickness.

7. The fixing device according to claim 1, wherein the pressing rotary body mover moves the pressing rotary body to a second position where the fixing nip is away from the protrusion when the recording medium is an envelope.

8. An image forming apparatus comprising:

an image forming device to form a toner image on a recording medium according to image data; and the fixing device according to claim 1.

9. The image forming apparatus according to claim 8, further comprising a thermohygrometer to detect an ambient temperature and humidity of the image forming apparatus, wherein when the ambient temperature and humidity detected by the thermohygrometer is higher than a predetermined value, the pressing rotary body mover moves the pressing rotary body to a first position where the fixing nip is disposed in proximity to the protrusion.

10. The image forming apparatus according to claim 8, further comprising an image pattern detector to detect an image pattern contained in the image data, wherein when the image pattern detector detects that an amount of toner adhered to a leading edge of the recording medium in the conveyance direction of the recording medium is greater than a predetermined value, the pressing rotary body mover moves the pressing rotary body to a first position where the fixing nip is disposed in proximity to the protrusion.

11. The fixing device according to claim 1, wherein the nip formation pad includes an arcuate recess extending from the protrusion towards the fixing nip, wherein the arcuate recess has a curvature corresponding to a curvature of the pressing rotary body.

12. A fixing device for fixing a toner image on a recording medium, comprising:

a flexible endless fixing belt formed into a loop; and a pressing rotary body disposed outside the loop formed by the fixing belt, a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body; and a pressing rotary body mover to contact and move the pressing rotary body bidirectionally in the conveyance direction of the recording medium to move the fixing nip toward and away from the protrusion, wherein the pressing rotary body mover includes a cam.

13. A fixing device for fixing a toner image on a recording medium, comprising:

a flexible endless fixing belt formed into a loop; and a pressing rotary body disposed outside the loop formed by the fixing belt, a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body; and a pressing rotary body mover to contact and move the pressing rotary body bidirectionally in the conveyance direction of the recording medium to move the fixing nip toward and away from the protrusion, wherein the pressing rotary body mover moves the pressing rotary body to a first position where the fixing nip is disposed in proximity to the protrusion when the recording medium has a thickness smaller than a predetermined thickness.

14. A fixing device for fixing a toner image on a recording medium, comprising:

a flexible endless fixing belt formed into a loop; and a pressing rotary body disposed outside the loop formed by the fixing belt, a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body; and a pressing rotary body mover to contact and move the pressing rotary body bidirectionally in the conveyance direction of the recording medium to move the fixing nip toward and away from the protrusion, wherein the pressing rotary body mover moves the pressing rotary body to a second position where the fixing nip is away from the protrusion when the recording medium is an envelope.

15. An image forming apparatus comprising:

an image forming device to form a toner image on a recording medium according to image data;

a fixing device including:

a flexible endless fixing belt formed into a loop, a pressing rotary body disposed outside the loop formed by the fixing belt, a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body, a pressing rotary body mover to contact and move the pressing rotary body bidirectionally in the conveyance direction of the recording medium to move the fixing nip toward and away from the protrusion; and a thermohygrometer to detect an ambient temperature and humidity of the image forming apparatus, wherein when the ambient temperature and humidity detected by the thermohygrometer is higher than a predetermined value, the pressing rotary body mover moves the pressing rotary body to a first position where the fixing nip is disposed in proximity to the protrusion.

16. An image forming apparatus comprising:

an image forming device to form a toner image on a recording medium according to image data;

a fixing device including:

a flexible endless fixing belt formed into a loop, a pressing rotary body disposed outside the loop formed by the fixing belt, a nip formation pad disposed inside the loop formed by the fixing belt and pressed against the pressing rotary body via the fixing belt to form a fixing nip between the pressing rotary body and the fixing belt through which the recording medium bearing the toner image is conveyed, the nip formation pad including a protrusion disposed downstream from the fixing nip in a conveyance direction of the recording medium, the protrusion protruding toward the pressing rotary body without contacting the pressing rotary body, a pressing rotary body mover to contact and move the pressing rotary body bidirectionally in the conveyance direction of the recording medium to move the fixing nip toward and away from the protrusion; and an image pattern detector to detect an image pattern contained in the image data, wherein when the image pattern detector detects that an amount of toner adhered to a leading edge of the recording medium in the conveyance direction of the recording medium is greater than a predetermined value, the pressing rotary body mover moves the pressing rotary body to a first position where the fixing nip is disposed in proximity to the protrusion.

* * * * *